US010476119B2

(12) United States Patent
Borysenko

(10) Patent No.: US 10,476,119 B2
(45) Date of Patent: Nov. 12, 2019

(54) LOW DISPERSION PHASE SHIFTER BASED ON MODIFIED HYBRID RING POWER DIVIDER

(71) Applicant: Honeywell International Inc., Morris Plains, NJ (US)

(72) Inventor: Sergiy Borysenko, Ottawa (CA)

(73) Assignee: Honeywell International Inc., Morris Plains, NJ (US)

( * ) Notice: Subject to any disclaimer, the term of this patent is extended or adjusted under 35 U.S.C. 154(b) by 0 days.

(21) Appl. No.: 15/482,048

(22) Filed: Apr. 7, 2017

(65) Prior Publication Data

US 2018/0294537 A1 Oct. 11, 2018

(51) Int. Cl.
*H01P 1/18* (2006.01)
*H01P 5/22* (2006.01)

(52) U.S. Cl.
CPC ..... *H01P 1/184* (2013.01); *H01P 5/222* (2013.01)

(58) Field of Classification Search
CPC .. H01P 5/22; H01P 5/222; H01P 5/225; H01P 5/227; H01P 1/185; H01P 1/184; H01P 1/213
See application file for complete search history.

(56) References Cited

U.S. PATENT DOCUMENTS 4,420,839 A * 12/1983 Hogerheiden, Jr. .... H01P 5/222 333/120
4,749,969 A 6/1988 Boire et al.
4,878,062 A 10/1989 Craven et al.
8,072,291 B2 12/2011 Itoh et al.
8,698,577 B2 4/2014 Sherrer et al.
2011/0140802 A1 6/2011 Pruvost
2013/0050012 A1 2/2013 Jungmaier et al.
2013/0064557 A1 3/2013 Hu et al.

FOREIGN PATENT DOCUMENTS

WO 2014192255 A1 12/2014

OTHER PUBLICATIONS

European Patent Office, "Extended European Search Report for EP Application No. 18165275.1", Foreign Counterpart to U.S. Appl. No. 15/482,048, dated Jul. 27, 2018, pp. 1-10.
(Continued)

*Primary Examiner* — Robert J Pascal
*Assistant Examiner* — Kimberly E Glenn
(74) *Attorney, Agent, or Firm* — Fog & Powers LLC

(57) ABSTRACT

A phase shifter device is disclosed and comprises a continuous transmission line on a substrate, and a plurality of ports coupled to the continuous transmission line and spaced apart from each other around the continuous transmission line. The plurality of ports comprises a first port, a second port, a third port, a fourth port, and a fifth port. A radio frequency (RF) switch is operative to connect either the first port or the fifth port to a main RF line that is coupled to one or more antennas. The second port is located between the first port and the third port, and the fourth port is located between the fifth port and the third port. In an alternative embodiment, the phase shifter device is combined with a circular polarization quadrature divider.

17 Claims, 3 Drawing Sheets

(56) References Cited

OTHER PUBLICATIONS

Kholodnyak et al. "Broadband Microwave Devices based on Artificial Transmission Lines" Proceedings of the 5th European Conference Antennas and Propagation (EUCAP), IEEE, Apr. 11, 2011, pp. 2669-2673.

Kumar et al., "Various PSK Modulation Schemes for Wireless Communication", 2011 2nd International Conference on Computer and Communication Technology (ICCCT), Sep. 15, 2011, pp. 545-549.

* cited by examiner

LOW DISPERSION PHASE SHIFTER BASED ON MODIFIED HYBRID RING POWER DIVIDER

BACKGROUND

The use of antennas on mobile platforms has grown dramatically with an increased demand by users to stay in touch in a more mobile society. This increased demand spans bidirectional exchange of data using mobile platforms for both personal and business needs. To meet this need, a moving platform, such as an automobile, boat, or airplane, typically uses an antenna that is able to track or "lock onto" a signal source, such as a satellite or terrestrial base station. In particular, phased array antennas with beam steering functionality often are used to provide this capability.

Phased array antennas typically use a number of phase shifters to vary the phase of radio frequency (RF) signals in a coordinated manner across the radiator elements of the antenna array to point the beam of the antenna in a desired direction. This type of beam steering can be used to track or lock onto a target regardless of the movement of the platform to which the antenna is attached. A phased array antenna is usually bidirectional, in that the beam of the antenna can be pointed to a target, such as a satellite, to both receive signals from and send signals to the satellite, or another component in the communication system. In other words, a phase shifter in a reciprocal antenna can facilitate full duplex communications in a mobile communication system.

For satellite communication (Satcom) systems, circular polarization (CP) is utilized, which usually requires a special CP forming network suitable for selected radiation elements. In the case of phased array antennas mounted on airplanes, referred to as aeronautical antennas, a number of design factors are important beyond the beam steering capability of the antenna.

For example, the phase shifters, as well as the CP forming networks, should be as small as possible, thus reducing the amount of space on a circuit board onto which they are mounted with other antenna components. Also, the phase shifters and CP forming networks should have the lowest possible insertion loss and minimal phase delay variation over a required frequency band. These and other design considerations are sometimes in conflict, making different configurations preferable for different applications depending on the importance of the various design considerations for the particular application. Phase shifters suitable for the applications described above are often connected in a series of stages, with a first course phase step followed by finer phase step phase shifter stages, to deliver desired phase shifts with a required resolution to each antenna element.

SUMMARY

A phase shifter device is disclosed and comprises a continuous transmission line on a substrate, and a plurality of ports coupled to the continuous transmission line and spaced apart from each other around the continuous transmission line. The plurality of ports comprises a first port, a second port, a third port, a fourth port, and a fifth port. A radio frequency (RF) switch is operative to connect either the first port or the fifth port to a main RF line that is coupled to one or more antennas. The second port is located between the first port and the third port, and the fourth port is located between the fifth port and the third port. In an alternative embodiment, the phase shifter device is combined with a circular polarization quadrature divider.

BRIEF DESCRIPTION OF THE DRAWINGS

Features of the present invention will become apparent to those skilled in the art from the following description with reference to the drawings. Understanding that the drawings depict only typical embodiments and are not therefore to be considered limiting in scope, the invention will be described with additional specificity and detail through the use of the accompanying drawings, in which.

DETAILED DESCRIPTION

Figure 1:
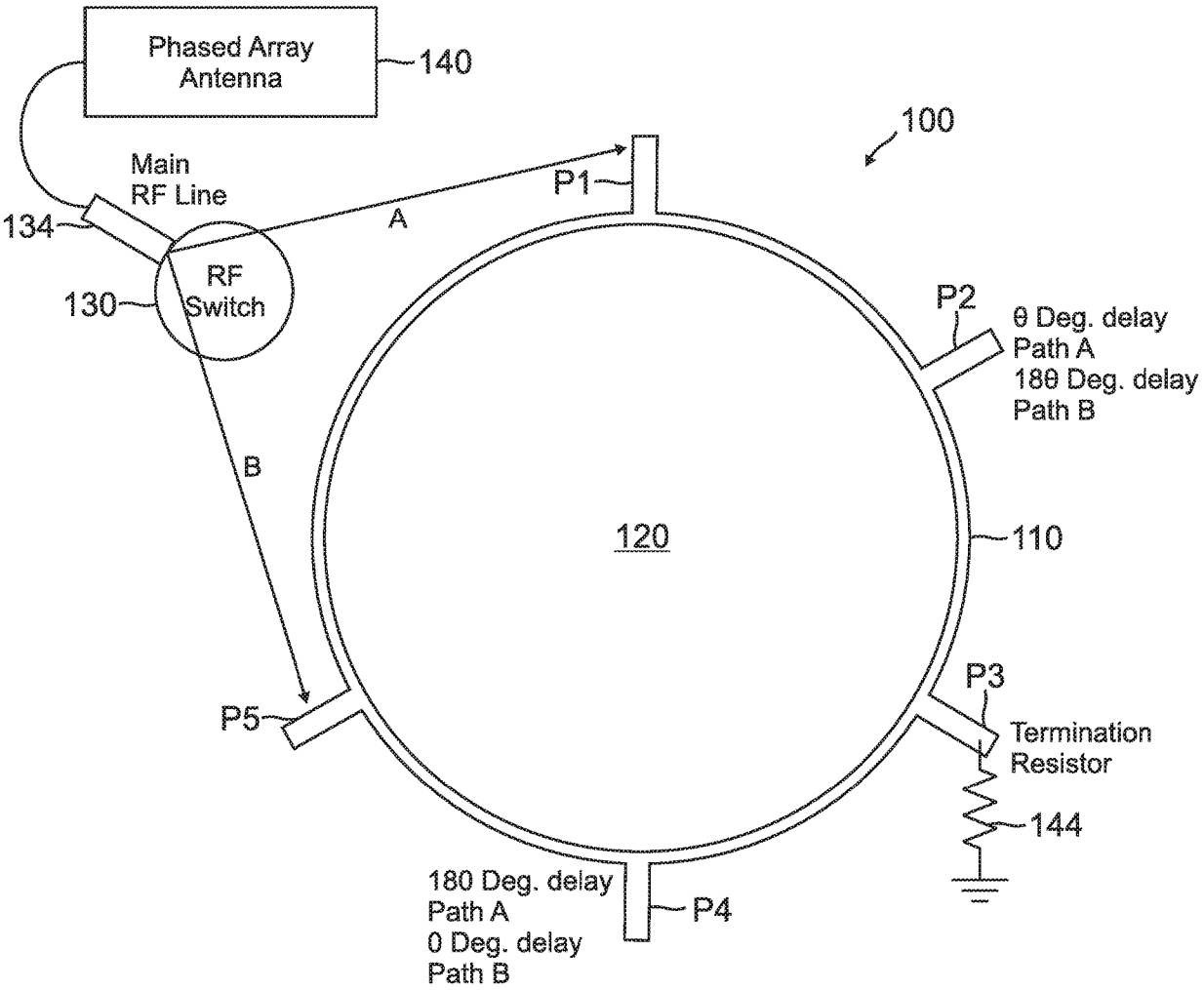
FIG. 1 is simplified functional schematic diagram of a phase shifter device, according to one embodiment.

In the following detailed description, embodiments are described in sufficient detail to enable those skilled in the art to practice the invention. It is to be understood that other embodiments may be utilized without departing from the scope of the invention. The following detailed description is, therefore, not to be taken in a limiting sense.

A phase shifter device is described herein, which can be utilized with a phased array antenna. The phase shifter device has low dispersion and is based on a modified hybrid ring power divider/coupler topology.

In one embodiment, the phase shifter device is implemented based on a modified rat-race 180 degree hybrid divider/coupler. This enables the phase shifter device to be used as a 180 degree coarse step phase shifter in a circularly polarized antenna array. In typical prior implementations, the rat race divider includes a transmission line wrapped as a ring with a 1.5 wavelength circumference, and four ports connected to the ring with equal 0.25 wavelength separation. In the phase shifter device of the proposed embodiment, a hybrid ring divider/coupler has an extra fifth port attached to the ring such that the fifth port is separated from the fourth port by 0.25 wavelength, so the shortest distance between the first port and the fifth port is one-half (0.5) wavelength (or 180 degrees).

A radio frequency (RF) switch is implemented to connect either the first port or the fifth port to a main RF line, which can be coupled to a phased array antenna. The RF switch can be a SPDT (Single-Pole/Dual-Throws) RF switch, such as a PIN diode switch. The RF switch allows a signal from the main RF line to be transmitted to either the first port or the fifth port on the ring, depending on the desired phase delay at the output ports (second port and fourth port). The third port on the ring is terminated to ground.

In a manufacturable embodiment, the layout of the phase shifter device is modified such that the first port and the fifth port are located close to each other and to the main RF line, which makes possible to use commercially available RF switches such as PIN diodes in a surface mount package. In this embodiment, the main RF line needs to be as close as possible to the first and fifth ports and to the hybrid ring for acceptable RF performance. The portion of the transmission line between the first port and the fifth port is deformed into a compact, meandering shaped line. An RF switch such as PIN diode switch is mounted in close proximity to the first port, the fifth port, and the main RF line.

In a further embodiment, a combined phase shifter and circular polarization (CP) quadrature divider device is provided. In this embodiment, the internal area of the ring divider/coupler is utilized for the CP quadrature divider to produce a CP forming network. In this arrangement, the CP forming network is combined with a coarse 180 degree step phase shifter to produce a low loss compact structure, which outperforms prior topologies where phase shifters and quadrature dividers are cascaded as different structures.

The present approach provides a way of reducing the area occupied by a coarse phase shifter stage and a CP forming network structure, as well as improving overall insertion loss performance, by combining these two structures. The proposed phase shifter topology also has a unique, very low phase delay variation over a wide frequency band. The phase shifter can also be suitable for high speed phase shift keying modulation systems where differential output is required. In addition, the phase shifter provides the advantages of compact size, low signal loss, and a near zero phase dispersion.

In implementing of the proposed phase shifter and CP forming network structures, common RF design practice can be followed in order to create transmission lines with the required impedance and electrical length. In addition, care should be taken in order to minimize unwanted coupling between closely placed sections of transmission lines. Suitable computer aided design tools can be used in order to optimally adjust the shape of all transmission lines for the best board area utilization.

The phase shifter and combined structures can be fabricated on a printed circuit board (PCB) using standard microstrip technology. A typical microstrip implementation utilizes RF structures, lines, and the like, which are formed on top of a dielectric material. The dielectric material is generally formed on a conductive, ground plane.

Further details of the present approach are described hereafter with reference to the drawings.

FIG. 1 illustrates a simplified functional circuit diagram of a phase shifter device 100, based on a modified rat race divider/coupler, according to one embodiment. The phase shifter device 100 includes a continuous, ring-shaped transmission line 110, which can be formed on a substrate 120. A plurality of ports is coupled to transmission line 110, with the ports spaced apart from each other around transmission line 110. The plurality of ports include a first port P1, a second port P2, a third port P3, a fourth port P4, and a fifth port P5, which are located in clockwise order around transmission line 110. The structure of phase shifter device 100 is perfectly symmetrical with an imaginary line of symmetry connecting a main RF line 134 and third port P3.

An RF switch 130 is operative to connect either first port P1 or fifth port P5 to main RF line 134, which is coupled to one or more antennas within a phased array antenna 140. The third port P3 is connected to ground through a termination resistor 144. In an exemplary embodiment, RF switch 130 can be implemented with a pair of PIN diodes.

The second port P2 is located between first port P1 and third port P3 such that when RF switch 130 connects first port P1 to main RF line 134 (path A), there is a small phase delay (x) to a signal traveling between main RF line 134 and second port P2 (called 0 degree phase state). In this configuration, there is x plus 180 degree phase delay between main RF line 134 and fourth port P4 (called 180 degree phase state).

Due to inherent symmetry, when RF switch 130 connects fifth port P5 to main RF line 134 (path B), the delay conditions on ports P2 and P4 change to the opposite, i.e., small phase delay (x) now is between main RF line 134 and port P4 (0 degree phase state), and the x plus 180 degree phase delay is between main RF line 134 and port P2 (180 degree phase state).

When RF switch 130 connects either port P1 or port P5 to main RF line 134, port P2 and port P4 are configured as signal output ports.

Figure 2:
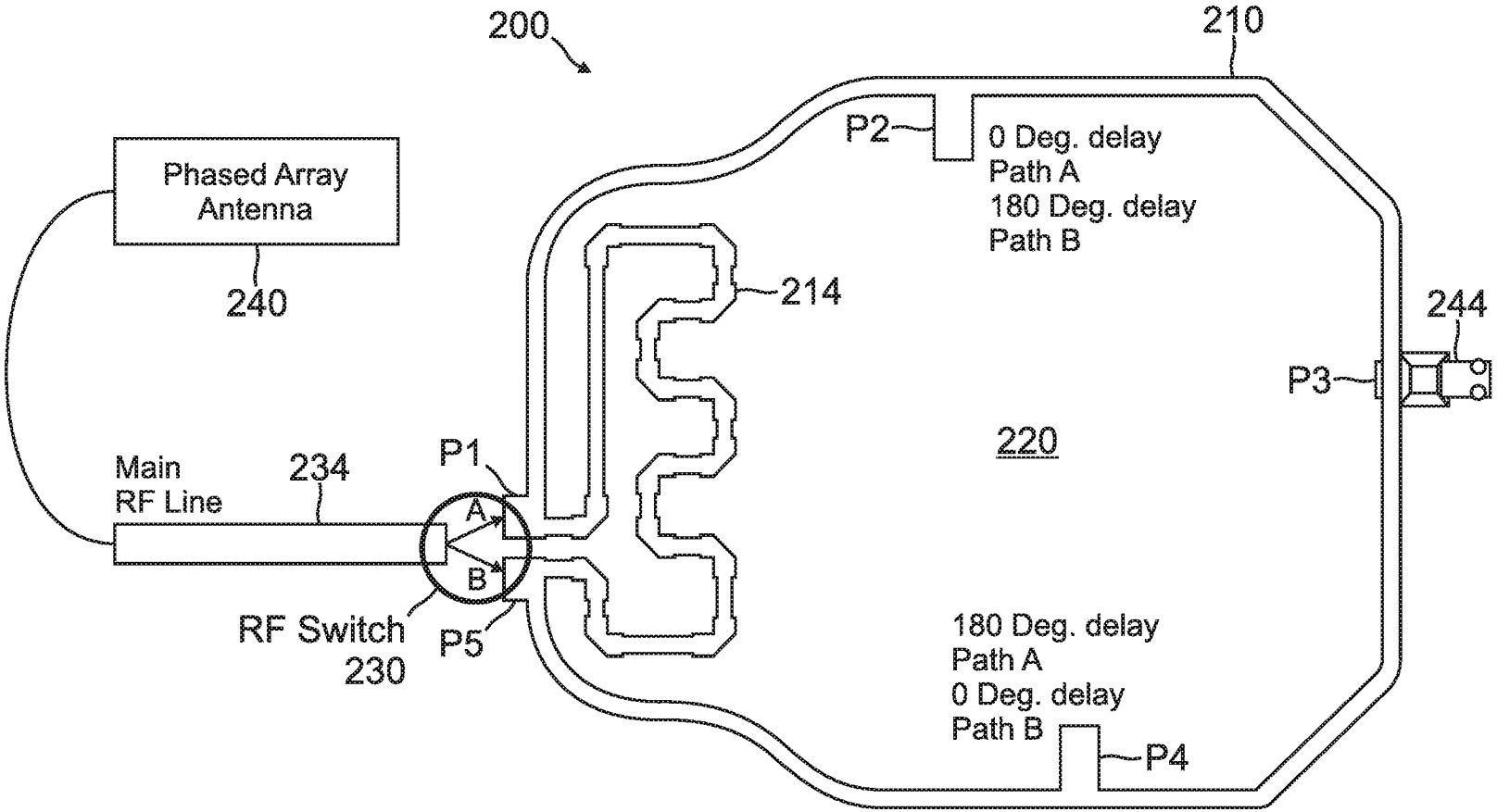
FIG. 2 is a schematic diagram of a manufacturable phase shifter device, according to another embodiment.

FIG. 2 illustrates a phase shifter device 200, according to a practical manufacturable embodiment. The phase shifter device 200 includes features similar to those in phase shifter device 100 (FIG. 1), including a plurality of ports that are coupled to a continuous transmission line 210, which can be formed on a substrate 220. The plurality of ports comprise a first port P1, a second port P2, a third port P3, a fourth port P4, and a fifth port P5, which are located in clockwise order around continuous transmission line 210.

An RF switch 230 is operative to connect either first port P1 or fifth port P5 to a main RF line 234, which is coupled to one or more antennas within a phased array antenna 240. The third port P3 is connected to ground through a termination resistor 244. In an exemplary embodiment, RF switch 230 can be implemented with a pair of PIN diodes.

As shown in FIG. 2, continuous transmission line 210 has a deformed, tortuous shape, such that first port P1 and fifth port P5 are located adjacent to each other and to main RF line 234. As such, continuous transmission line 210 includes a compact meandering portion 214 that is connected between first port P1 and fifth port P5. The compact meandering portion 214 is located within a perimeter defined by the remainder of continuous transmission line 210.

When RF switch 230 connects first port P1 to main RF line 234, second port P2 provides a 0 degree phase state to a signal traveling along continuous transmission line 210 in a clockwise direction (path A) from first port P1 to second port P2. In addition, with RF switch 230 connecting first port P1 to main RF line 234, fourth port P4 provides a 180 degree phase state to the signal traveling along continuous transmission line 210 in the clockwise direction from first port P1 to fourth port P4.

When RF switch 230 connects fifth port P5 to main RF line 234, second port P2 provides a 180 degree phase state to a signal traveling along continuous transmission line 210 in a counter-clockwise direction (path B) from fifth port P5 to second port P2. In addition, when RF switch 230 connects fifth port P5 to main RF line 234, fourth port P4 provides a 0 degree phase state to the signal traveling along continuous transmission line 210 in the counter-clockwise direction from fifth port P5 to fourth port P4.

When RF switch 230 connects either first port P1 or fifth port P5 to main RF line 234, second port P2 and fourth port P4 are configured as signal output ports. In one implementation, phase shifter device 200 is optimized for L-band transmissions.

Figure 3:
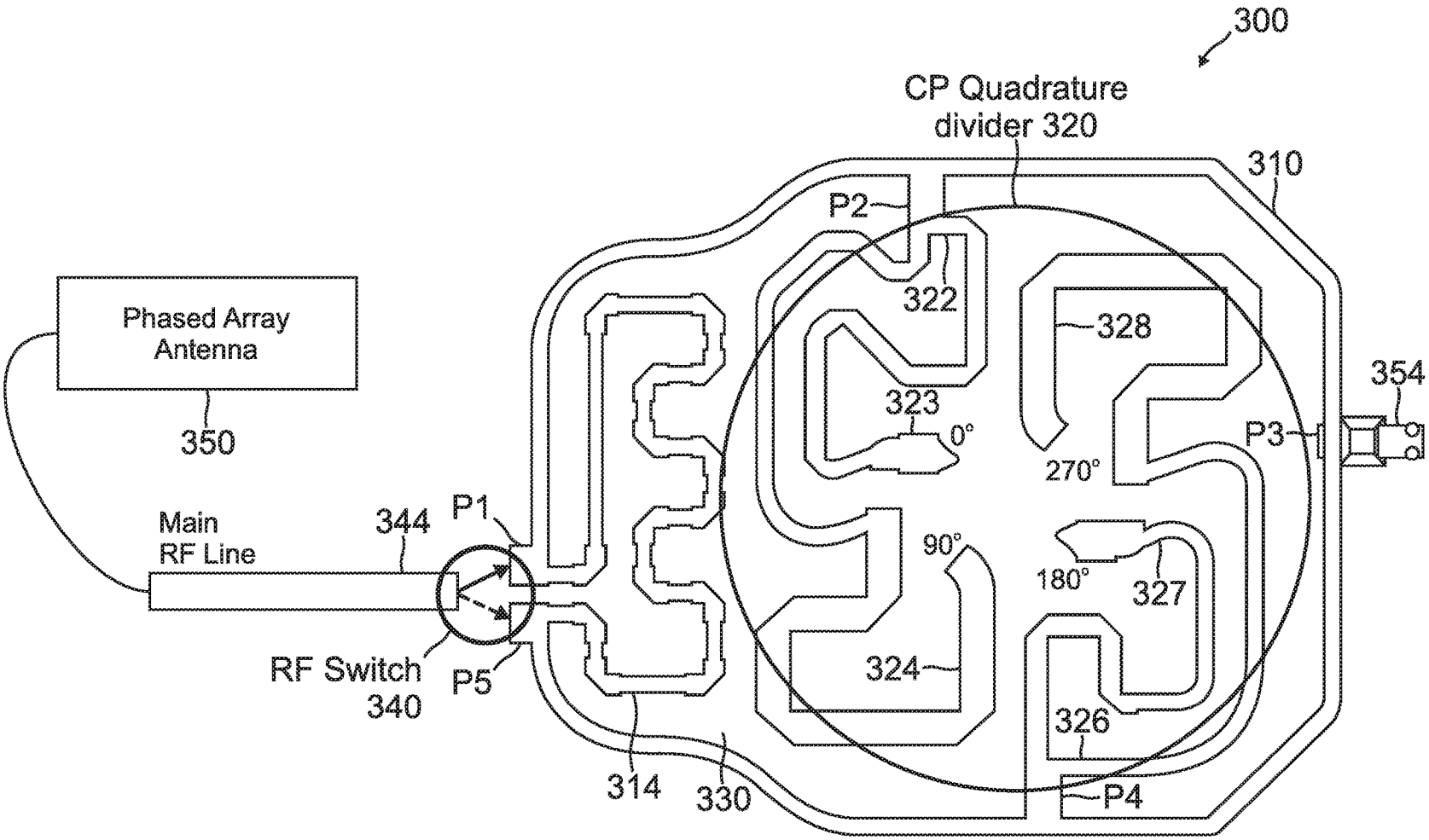
FIG. 3 is a schematic diagram of a combined phase shifter and quadrature divider device, according to a further embodiment.

FIG. 3 illustrates a combined phase shifter and CP quadrature divider device 300, according to a further embodiment. A phase shifter portion of device 300 includes features similar to those in phase shifter device 200 (FIG. 2), including a plurality of ports that are coupled to a continuous transmission line 310, which can be formed on a substrate 330. The plurality of ports comprise a first port P1, a second port P2, a third port P3, a fourth port P4, and a fifth port P5. In addition, continuous transmission line 310 has a deformed, tortuous shape, such that first port P1 and fifth port P5 are located adjacent to each other. The continuous transmission line 310 includes a compact meandering portion 314 that is connected between first port P1 and fifth port P5. The compact meandering portion 314 is located within a perimeter defined by the remainder of continuous transmission line 310.

A CP quadrature divider portion 320 of device 300 is coupled to continuous transmission line 310, with CP quadrature divider portion 320 located within the perimeter defined by the remainder of continuous transmission line 310. The CP quadrature divider portion 320 comprises a first section 322 coupled to second port P2, and a second section 326 coupled to fourth port P4. The first section 322 of CP quadrature divider portion 320 includes a first meandering line segment 323, and a second meandering line segment 324. The second section 326 of CP quadrature divider portion 320 includes a first meandering line segment 327, and a second meandering line segment 328. The CP quadrature divider portion 320 utilized as a CP forming network.

An RF switch 340 is operative to connect either first port P1 or fifth port P5 to a main RF line 344, which is coupled to one or more antennas within a phased array antenna 350. The third port P3 is connected to ground through a termination resistor 354. In an exemplary embodiment, RF switch 340 can be implemented with a pair of PIN diodes.

When RF switch 340 connects first port P1 to main RF line 344, first section 322 of CP quadrature divider portion 320 provides a 0 degree relative phase delay through line segment 323, and a 90 degree relative phase delay through line segment 324, for a signal traveling between first port P1 and second port P2. With RF switch 340 connecting first port P1 to main RF line 344, second section 326 of CP quadrature divider portion 320 provides a 180 degree relative phase delay through line segment 327, and a 270 degree relative phase delay through line segment 328, for a signal traveling between first port P1 and fourth port P4.

When RF switch 340 connects fifth port P5 to main RF line 344, second section 326 of CP quadrature divider portion 320 provides a 0 degree relative phase delay through line segment 327, and a 90 degree relative phase delay through line segment 328, for a signal traveling between fifth port P5 and fourth port P4. With RF switch 340 connecting fifth port P5 to main RF line 344, first section 322 of CP quadrature divider portion 320 provides a 180 degree relative phase delay through line segment 323, and a 270 degree relative phase delay through line segment 324, for a signal traveling between fifth port P5 and second port P2.

EXAMPLE EMBODIMENTS

Example 1 includes a phase shifter device comprising: a continuous transmission line on a substrate; a plurality of ports coupled to the continuous transmission line and spaced apart from each other around the continuous transmission line, the plurality of ports comprising a first port, a second port, a third port, a fourth port, and a fifth port; and a radio frequency (RF) switch operative to connect either the first port or the fifth port to a main RF line that is coupled to one or more antennas; wherein the second port is located between the first port and the third port, and the fourth port is located between the fifth port and the third port.

Example 2 includes the phase shifter device of Example 1, wherein the second port is located between the first port and the third port such that when the RF switch connects the first port to the main RF line, a signal traveling between the main RF line and the second port has a 0 degree phase state.

Example 3 includes the phase shifter device of any of Examples 1-2, wherein the fourth port is located between the fifth port and the third port such that when the RF switch connects the first port to the main RF line, a signal traveling between the main RF line and the fourth port has a 180 degree phase state.

Example 4 includes the phase shifter device of Example 1, wherein the second port is located between the first port and the third port such that when the RF switch connects the fifth port to the main RF line, a signal traveling between the main RF line and the second port has a 180 degree phase state.

Example 5 includes the phase shifter device of any of Examples 1 and 4, wherein the fourth port is located between the fifth port and the third port such that when the RF switch connects the fifth port to the main RF line, a signal traveling between the main RF line and the fourth port has a 0 degree phase state.

Example 6 includes the phase shifter device of any of Examples 1-5, wherein the RF switch comprises a pair of PIN diodes.

Example 7 includes the phase shifter device of any of Examples 1-6, wherein the main RF line is coupled to a phased array antenna.

Example 8 includes the phase shifter device of any of Examples 1-7, wherein the third port is connected to ground through a termination resistor.

Example 9 includes the phase shifter device of any of Examples 1-8, wherein the continuous transmission line has a ring-shaped arrangement.

Example 10 includes the phase shifter device of any of Examples 1-9, wherein the continuous transmission line has a tortuous-shaped arrangement.

Example 11 includes the phase shifter device of Example 10, wherein the continuous transmission line is arranged such that the first port and the fifth port are located adjacent to each other and the main RF line.

Example 12 includes the phase shifter device of Example 11, wherein a portion of the continuous transmission line, between the first port and the fifth port, has a compact meandering-shaped arrangement, wherein the portion of the continuous transmission line is located within a perimeter defined by a remainder of the continuous transmission line.

Example 13 includes the phase shifter device of Example 12, further comprising a circular polarization (CP) quadrature divider coupled to the continuous transmission line, the CP quadrature divider located within the perimeter defined by the remainder of the continuous transmission line.

Example 14 includes the phase shifter device of Example 13, wherein the CP quadrature divider comprises a first section coupled to the second port, and a second section coupled to the fourth port, the first and second sections having a compact meandering-shaped arrangement.

Example 15 includes the phase shifter device of Example 14, wherein the first section of the CP quadrature divider includes a first transmission line segment, and a second transmission line segment.

Example 16 includes the phase shifter device of Example 15, wherein the second section of the CP quadrature divider includes a first transmission line segment, and a second transmission line segment.

Example 17 includes a combined device comprising a phase shifter portion that comprises a continuous transmission line on a substrate; and a plurality of ports coupled to the continuous transmission line and spaced apart from each other around the continuous transmission line, the plurality of ports comprising a first port, a second port, a third port, a fourth port, and a fifth port; wherein a portion of the continuous transmission line, between the first port and the fifth port, has a compact meandering-shaped arrangement, the portion of the continuous transmission line located within a perimeter defined by a remainder of the continuous transmission line; wherein the continuous transmission line is arranged such that the first port and the fifth port are located adjacent to each other. The combined device also comprises a CP quadrature divider portion coupled to the continuous transmission line, the CP quadrature divider located within the perimeter defined by the remainder of the continuous transmission line, with the CP quadrature divider portion comprising: a first section coupled to the second port, the first section including a first transmission line segment and a second transmission line segment; and a second section coupled to the fourth port, the second section including a first transmission line segment and a second transmission line segment; wherein the first and second sections have a compact meandering-shaped arrangement. A radio frequency (RF) switch is operative to connect either the first port or the fifth port to a main RF line that is coupled to a phased array antenna.

Example 18 includes the combined device of Example 17, wherein when the RF switch connects the first port to the main RF line: the first transmission line segment of the first section provides a 0 degree relative phase delay, and the second transmission line segment of the first section provides a 90 degree relative phase delay, for a signal traveling between the first port and the second port; and the first transmission line segment of the second section provides a 180 degree relative phase delay, and the second transmission line segment of the second section provides a 270 degree relative phase delay, for a signal traveling between the first port and the fourth port.

Example 19 includes the combined device of Example 17, wherein when the RF switch connects the fifth port to the main RF line: the first transmission line segment of the second section provides a 0 degree relative phase delay, and the second transmission line segment of the second section provides a 90 degree relative phase delay, for a signal traveling between the fifth port and the fourth port; and the first transmission line segment of the first section provides a 180 degree relative phase delay, and the second transmission line segment of the first section provides a 270 degree relative phase delay, for a signal traveling between the fifth port and the second port.

Example 20 includes the combined device of any of Examples 17-19, wherein the RF switch comprises a pair of PIN diodes; and the third port is connected to ground through a termination resistor.

The present invention may be embodied in other specific forms without departing from its essential characteristics. The described embodiments are to be considered in all respects only as illustrative and not restrictive. The scope of the invention is therefore indicated by the appended claims rather than by the foregoing description. All changes that come within the meaning and range of equivalency of the claims are to be embraced within their scope.

What is claimed is:

1. A phase shifter device, comprising:

a continuous transmission line on a substrate, wherein the continuous transmission line has a tortuous-shaped arrangement;

a plurality of ports coupled to the continuous transmission line and spaced apart from each other around the continuous transmission line, the plurality of ports comprising a first port, a second port, a third port, a fourth port, and a fifth port; and a radio frequency (RF) switch operative to connect either the first port or the fifth port to a main RF line that is coupled to one or more antennas;

wherein the second port is located between the first port and the third port, and the fourth port is located between the fifth port and the third port;

wherein the continuous transmission line is arranged such that the first port and the fifth port are located adjacent to each other and the main RF line.

2. The phase shifter device of claim 1, wherein the second port is located between the first port and the third port such that when the RF switch connects the first port to the main RF line, a signal traveling between the main RF line and the second port has a 0 degree phase state.

3. The phase shifter device of claim 1, wherein the fourth port is located between the fifth port and the third port such that when the RF switch connects the first port to the main RF line, a signal traveling between the main RF line and the fourth port has a 180 degree phase state.

4. The phase shifter device of claim 1, wherein the second port is located between the first port and the third port such that when the RF switch connects the fifth port to the main RF line, a signal traveling between the main RF line and the second port has a 180 degree phase state.

5. The phase shifter device of claim 1, wherein the fourth port is located between the fifth port and the third port such that when the RF switch connects the fifth port to the main RF line, a signal traveling between the main RF line and the fourth port has a 0 degree phase state.

6. The phase shifter device of claim 1, wherein the RF switch comprises a pair of PIN diodes.

7. The phase shifter device of claim 1, wherein the one or more antennas are within a phased array antenna.

8. The phase shifter device of claim 1, wherein the third port is connected to ground through a termination resistor.

9. The phase shifter device of claim 1, wherein a portion of the continuous transmission line, between the first port and the fifth port, has a compact meandering-shaped arrangement, wherein the portion of the continuous transmission line is located within a perimeter defined by a remainder of the continuous transmission line.

10. The phase shifter device of claim 9, further comprising a circular polarization (CP) quadrature divider coupled to the continuous transmission line, the CP quadrature divider located within the perimeter defined by the remainder of the continuous transmission line.

11. The phase shifter device of claim 10, wherein the CP quadrature divider comprises a first section coupled to the second port, and a second section coupled to the fourth port, the first and second sections having a compact meandering-shaped arrangement.

12. The phase shifter device of claim 11, wherein the first section of the CP quadrature divider includes a first transmission line segment, and a second transmission line segment.

13. The phase shifter device of claim 12, wherein the second section of the CP quadrature divider includes a first transmission line segment, and a second transmission line segment.

14. A combined device, comprising:

a phase shifter portion comprising:

a continuous transmission line on a substrate; and a plurality of ports coupled to the continuous transmission line and spaced apart from each other around the continuous transmission line, the plurality of ports comprising a first port, a second port, a third port, a fourth port, and a fifth port;

wherein a portion of the continuous transmission line, between the first port and the fifth port, has a compact meandering-shaped arrangement, the portion of the continuous transmission line located within a perimeter defined by a remainder of the continuous transmission line;

wherein the continuous transmission line is arranged such that the first port and the fifth port are located adjacent to each other;

a circular polarization (CP) quadrature divider portion coupled to the continuous transmission line, the CP quadrature divider located within the perimeter defined by the remainder of the continuous transmission line, the CP quadrature divider portion comprising:

a first section coupled to the second port, the first section including a first transmission line segment and a second transmission line segment; and a second section coupled to the fourth port, the second section including a first transmission line segment and a second transmission line segment;

wherein the first and second sections have a compact meandering-shaped arrangement; and a radio frequency (RF) switch operative to connect either the first port or the fifth port to a main RF line that is coupled to a phased array antenna.

15. The combined device of claim 14, wherein when the RF switch connects the first port to the main RF line:

the first transmission line segment of the first section provides a 0 degree relative phase delay, and the second transmission line segment of the first section provides a 90 degree relative phase delay, for a signal traveling between the first port and the second port; and the first transmission line segment of the second section provides a 180 degree relative phase delay, and the second transmission line segment of the second section provides a 270 degree relative phase delay, for a signal traveling between the first port and the fourth port.

16. The combined device of claim 14, wherein when the RF switch connects the fifth port to the main RF line:

the first transmission line segment of the second section provides a 0 degree relative phase delay, and the second transmission line segment of the second section provides a 90 degree relative phase delay, for a signal traveling between the fifth port and the fourth port; and the first transmission line segment of the first section provides a 180 degree relative phase delay, and the second transmission line segment of the first section provides a 270 degree relative phase delay, for a signal traveling between the fifth port and the second port.

17. The combined device of claim 14, wherein:

the RF switch comprises a pair of PIN diodes; and the third port is connected to ground through a termination resistor.

* * * * *